US011286626B2

(12) United States Patent
Grove et al.

(10) Patent No.: US 11,286,626 B2
(45) Date of Patent: Mar. 29, 2022

(54) CONTROLLING COMPACTION OF A SUBSTRATE BY A SURFACE COMPACTOR MACHINE

(71) Applicant: Volvo Construction Equipment AB, Eskilstuna (SE)

(72) Inventors: Christopher Grove, Fayetteville, PA (US); Robert Heinl, Shippensburg, PA (US); Chad Fluent, Saint Thomas, PA (US)

(73) Assignee: Volvo Construction Equipment AB, Eskilstuna (SE)

( * ) Notice: Subject to any disclaimer, the term of this patent is extended or adjusted under 35 U.S.C. 154(b) by 145 days.

(21) Appl. No.: 16/766,047

(22) PCT Filed: Nov. 21, 2017

(86) PCT No.: PCT/US2017/062791
§ 371 (c)(1),
(2) Date: May 21, 2020

(87) PCT Pub. No.: WO2019/103723
PCT Pub. Date: May 31, 2019

(65) Prior Publication Data

US 2021/0395959 A1 Dec. 23, 2021

(51) Int. Cl.
*E01C 19/28* (2006.01)
*B06B 1/16* (2006.01)
*E02D 3/074* (2006.01)

(52) U.S. Cl.
CPC ..... *E01C 19/286* (2013.01); *B06B 1/16* (2013.01); *E02D 3/074* (2013.01)

(58) Field of Classification Search
CPC ..... E01C 19/286; B06B 1/16; E02D 3/074
(Continued)

(56) References Cited

U.S. PATENT DOCUMENTS 2,061,943 A * 11/1936 Jorgensen ..... E04G 21/08 366/123
3,722,390 A 3/1973 Kaltenegger
(Continued)

FOREIGN PATENT DOCUMENTS

CN 201261855 Y 6/2009
CN 102605706 A 7/2012
(Continued)

OTHER PUBLICATIONS

Chinese Notification for Patent Registration Formalities dated Mar. 25, 2021 for Chinese Patent Application No. 201780097012.2, 9 pages (including English translation).
(Continued)

*Primary Examiner* — Raymond W Addie
(74) *Attorney, Agent, or Firm* — Sage Patent Group

(57) ABSTRACT

A surface compactor machine includes a compacting surface for compacting a substrate, a first motor, a second motor, a support assembly, and a controller. The first motor rotates a first eccentric shaft. The second motor rotates a second eccentric shaft. The support assembly is connected to the first and second eccentric shafts to transfer vibration forces to the compacting surface. The controller controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

20 Claims, 10 Drawing Sheets

(58) Field of Classification Search
USPC ..... 404/84.05, 113, 117
See application file for complete search history.

(56) References Cited

U.S. PATENT DOCUMENTS

| | | | | |
|---|---|---|---|---|
| 3,892,496 | A * | 7/1975 | Lebrero Martinez | E01C 19/286 404/117 |
| 7,089,823 | B2 * | 8/2006 | Potts | E01C 19/288 404/117 |
| 8,393,826 | B1 * | 3/2013 | Marsolek | E01C 19/286 404/117 |
| 9,101,959 | B2 * | 8/2015 | Burton | B06B 1/161 |
| 9,725,855 | B2 * | 8/2017 | Kreische | E02D 3/074 |
| 9,926,675 | B2 | 3/2018 | MacDonald et al. | |
| 10,166,573 | B2 * | 1/2019 | Karcz | E01C 19/286 |
| 11,168,448 | B2 * | 11/2021 | Lanahan | E02D 3/074 |
| 2003/0079559 | A1 | 5/2003 | Potts | |
| 2011/0290048 | A1 * | 12/2011 | Stein | E02D 3/074 74/61 |
| 2015/0139731 | A1 * | 5/2015 | Persson | E02D 3/074 404/117 |
| 2017/0014867 | A1 * | 1/2017 | Smith | B06B 1/162 |
| 2017/0306574 | A1 | 10/2017 | MacDonald | |

FOREIGN PATENT DOCUMENTS

| | | | |
|---|---|---|---|
| CN | 103608518 | A | 2/2014 |
| CN | 104831603 | A | 8/2015 |
| CN | 105463969 | A | 4/2016 |
| DE | 19510562 | A1 | 9/1996 |
| DE | 102012201443 | A1 | 8/2013 |
| JP | 4746209 | B2 | 8/2011 |
| WO | 2017114546 | A2 | 7/2017 |

OTHER PUBLICATIONS

International Search Report and Written Opinion of the International Searching Authority, PCT/US2017/062791, dated Feb. 6, 2018, 7 pages.

* cited by examiner

CONTROLLING COMPACTION OF A SUBSTRATE BY A SURFACE COMPACTOR MACHINE

CROSS REFERENCE TO RELATED APPLICATIONS

This application is a 35 U.S.C. § 371 national stage application of PCT International Application No. PCT/US2017/062791 filed on Nov. 21, 2017, the disclosure and content of which is incorporated by reference herein in its entirety.

FIELD

The inventive concepts relate to surface compactors that rotate eccentric masses to generate vibration forces that induce mechanical compaction of a substrate.

BACKGROUND

Surface compactors are used to compact a variety of substrates including soil, asphalt, or other materials. Surface compactors are provided with one or more compacting surfaces for this purpose. For example, a roller compactor may be provided with one or more cylindrical drums that provide compacting surfaces for compacting substrates.

Roller compactors use the weight of the compactor applied through rolling drums to compress a surface of the substrate being rolled. In addition, one or more of the drums of some roller compactors may be vibrated by a vibration system to induce additional mechanical compaction of the substrate being rolled. The vibration system can include one or more eccentric masses that are rotated to generate a vibration force which excites the compacting surface of the drum. How the substrate to be compacted will respond to the force of the drum is dependent on several variables, such as dimensions of the drum, time that the drum is applying force, vibration amplitude, vibration frequency, and substrate characteristics, such as its density and temperature.

Known roller compactors typically need to repetitively pass over an asphalt substrate 5 to 7 times to achieve a typically desired compaction density. More compaction of the substrate can be obtained from each pass by applying more force from the roller surface. However, factors that limit how much force can be applied each pass include a need to avoid bow waves of the substrate material forming in front of the roller, avoid longitudinally displacing material of the substrate, avoid fracturing an aggregate of the substrate, and avoid leaving drum edge marks on the substrate.

For example, a bow wave can form during compaction when a mound of the substrate material builds up and is longitudinally pushed by the drum. A bow wave can be created by a compactor which has too much compaction weight for a provided drum diameter, which constrains the amount of compaction weight and the drum diameter that can be used. A bow wave can also be created by compacting a substrate while it is in a tender zone, such as while an asphalt substrate has an excessive temperature for compaction. One approach that is used to try to avoid creation of bow waves is to initially compact a substrate with a pneumatic tire type surface compactor or by a static roll pass type surface compactor, because these surface compactors do not use a vibration system for compaction. However, making one or more of these additional types of surface compactors available at a job site can increase cost, time, and/or complexity of a job.

SUMMARY

One embodiment of the inventive concepts is directed to a surface compactor machine that includes a compacting surface for compacting a substrate, a first motor, a second motor, a support assembly, and a controller. The first motor rotates a first eccentric shaft. The second motor rotates a second eccentric shaft. The support assembly is connected to the first and second eccentric shafts to transfer vibration forces to the compacting surface. The controller controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

Another embodiment of the inventive concepts is directed to a method of operating a surface compactor machine that has a compacting surface for compacting a substrate, a first motor that that rotates a first eccentric shaft, a second motor that rotates a second eccentric shaft, and a support assembly connected to the first and second eccentric shafts to transfer vibration forces to the compacting surface. The method includes operating a controller to control speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

Another embodiment of the inventive concepts is directed to a control system for a surface compactor machine that has a compacting surface for compacting a substrate, a first motor that rotates a first eccentric shaft, a second motor that rotates a second eccentric shaft, and a support assembly connected to the first and second eccentric shafts to transfer vibration forces to the compacting surface. The control system includes a controller that controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

Other surface compactor machines, methods, and control systems according to embodiments will be or become apparent to one with skill in the art upon review of the following drawings and detailed description. It is intended that all such additional surface compactor machines, methods, and control systems be included within this description and protected by the accompanying claims. Moreover, it is intended that all embodiments disclosed herein can be implemented separately or combined in any way and/or combination Aspects According to one aspect, a surface compactor machine includes a compacting surface for compacting a substrate, a first motor, a second motor, a support assembly, and a controller. The first motor rotates a first eccentric shaft. The second motor rotates a second eccentric shaft. The support assembly is connected to the first and second eccentric shafts to transfer vibration forces to the compacting surface. The controller controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards. The composite displacement waveform includes a zero amplitude coordinate. A wave section is located above the zero amplitude coordinate, and a wave section is located below the zero amplitude coordinate that is asymmetric relative to the wave section located above the zero amplitude coordinate.

In a further aspect, the wave section located below the zero amplitude coordinate includes a sequence of a first occurring downward peak, a second occurring upward peak, and a third occurring downward peak that has a larger downward amplitude than the first occurring downward peak.

In another further aspect, the maximum upward amplitude of the wave section located above the zero amplitude coordinate is greater than the maximum downward amplitude of the wave section located below the zero amplitude coordinate.

In another further aspect, the first eccentric shaft may have a greater mass than the second eccentric shaft. The first and second eccentric shafts may be coaxial aligned along their rotational axes, and at least a portion of the second eccentric shaft may be enclosed by the first eccentric shaft.

In some further aspects, the controller may be configured to control the speed of at least one of the first and second motors so that a center of mass location of the second eccentric shaft has a leading rotational angle offset ahead of a center of mass location of the first eccentric shaft in a direction of rotation of the first and second eccentric shafts when the center of mass location of the first eccentric shaft is at its maximum distance from the substrate. The first eccentric shaft may have a greater mass than the second eccentric shaft, and the controller may control the speed of at least one of the first and second motors so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate. The controller may control the speed of at least one of the first and second motors so that the rotational speed of the second eccentric shaft is 2 times faster than the rotational speed of the first eccentric shaft and so that the center of mass location of the second eccentric shaft has a leading rotational angle offset of about 15 degrees ahead of the center of mass location of the first eccentric shaft when the center of mass location of the first eccentric shaft is at its maximum distance from the substrate. The controller may control the speed of at least one of the first and second motors to regulate the leading rotational angle offset, from the center of mass location of the second eccentric shaft to the center of mass location of the first eccentric shaft when the center of mass location of the first eccentric shaft is at its maximum distance from the substrate, to be a value determined based on which operational mode among a plurality of operational modes has been electrically signaled to the controller as a selection by an operator of the surface compactor machine.

In some further aspects, the surface compactor machine may be a roller compactor, and the compacting surface may be a cylindrical drum that is connected to the support assembly and encloses the first and second eccentric shafts. The surface compactor machine may further include a first phase angle sensor configured to output a first signal indicating a rotational angle of the first eccentric shaft, and a second phase angle sensor configured to output a second signal indicating a rotational angle of the second eccentric shaft. The controller can be configured to control speed of at least one of the first and second motors responsive to a difference between the rotational angles indicated by the first and second signals.

According to another aspect, a method is provided for operating a surface compactor machine having a compacting surface for compacting a substrate, a first motor that that rotates a first eccentric shaft, a second motor that rotates a second eccentric shaft, and a support assembly connected to the first and second eccentric shafts to transfer vibration forces to the compacting surface. The method includes operating a controller to control speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards. The composite displacement waveform includes a zero amplitude coordinate. A wave section is located above the zero amplitude coordinate, and a wave section is located below the zero amplitude coordinate that is asymmetric relative to the wave section located above the zero amplitude coordinate.

In a further aspect, the wave section located below the zero amplitude coordinate includes a sequence of a first occurring downward peak, a second occurring upward peak, and a third occurring downward peak that has a larger downward amplitude than the first occurring downward peak.

In another further aspect, the maximum upward amplitude of the wave section located above the zero amplitude coordinate is greater than the maximum downward amplitude of the wave section located below the zero amplitude coordinate.

In some further aspects, the method may operate the controller to control the speed of at least one of the first and second motors so that a center of mass location of the second eccentric shaft has a leading rotational angle offset ahead of a center of mass location of the first eccentric shaft in a direction of rotation of the first and second eccentric shafts when the center of mass location of the first eccentric shaft is at its maximum distance from the substrate. The first eccentric shaft may have a greater mass than the second eccentric shaft, and the method may operate the controller to control the speed of at least one of the first and second motors so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate. The method may operate the controller to control the speed of at least one of the first and second motors so that the rotational speed of the second eccentric shaft is 2 times faster than the rotational speed of the first eccentric shaft and so that the center of mass location of the second eccentric shaft has a leading rotational angle offset of about 15 degrees ahead of the center of mass location of the first eccentric shaft when the center of mass location of the first eccentric shaft is at its maximum distance from the substrate. The method may operate the controller to control the speed of at least one of the first and second motors to regulate the leading rotational angle offset, from the center of mass location of the second eccentric shaft to the center of mass location of the first eccentric shaft when the center of mass location of the first eccentric shaft is at its maximum distance from the substrate, to be a value determined based on which operational mode among a plurality of operational modes has been electrically signaled to the controller as a selection by an operator of the surface compactor machine.

In another further aspect, the surface compactor machine may further include a first phase angle sensor configured to output a first signal indicating a rotational angle of the first eccentric shaft, and a second phase angle sensor configured to output a second signal indicating a rotational angle of the second eccentric shaft. The method may operate the controller to control speed of at least one of the first and second motors responsive to a difference between the rotational angles indicated by the first and second signals.

According to another aspect, a control system is provided for a surface compactor machine having a compacting surface for compacting a substrate, a first motor that rotates a first eccentric shaft, a second motor that rotates a second eccentric shaft, and a support assembly connected to the first and second eccentric shafts to transfer vibration forces to the compacting surface. The control system includes a controller that controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards. The composite displacement waveform includes a zero amplitude coordinate. A wave section is located above the zero amplitude coordinate, and a wave section is located below the zero amplitude coordinate that is asymmetric relative to the wave section located above the zero amplitude coordinate.

In a further aspect, the wave section located below the zero amplitude coordinate includes a sequence of a first occurring downward peak, a second occurring upward peak, and a third occurring downward peak that has a larger downward amplitude than the first occurring downward peak.

In another further aspect, the maximum upward amplitude of the wave section located above the zero amplitude coordinate is greater than the maximum downward amplitude of the wave section located below the zero amplitude coordinate.

In some further aspects, the controller may be configured to control the speed of at least one of the first and second motors so that a center of mass location of the second eccentric shaft has a leading rotational angle offset ahead of a center of mass location of the first eccentric shaft in a direction of rotation of the first and second eccentric shafts when the center of mass location of the first eccentric shaft is at its maximum distance from the substrate. The first eccentric shaft may have a greater mass than the second eccentric shaft, and the controller may control the speed of at least one of the first and second motors so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate. The controller may control the speed of at least one of the first and second motors so that the rotational speed of the second eccentric shaft is 2 times faster than the rotational speed of the first eccentric shaft and so that the center of mass location of the second eccentric shaft has a leading rotational angle offset of about 15 degrees ahead of the center of mass location of the first eccentric shaft when the center of mass location of the first eccentric shaft is at its maximum distance from the substrate. The controller may control the speed of at least one of the first and second motors to regulate the leading rotational angle offset, from the center of mass location of the second eccentric shaft to the center of mass location of the first eccentric shaft when the center of mass location of the first eccentric shaft is at its maximum distance from the substrate, to be a value determined based on which operational mode among a plurality of operational modes has been electrically signaled to the controller as a selection by an operator of the surface compactor machine.

In a further aspect, the surface compactor machine further includes a first phase angle sensor configured to output a first signal indicating a rotational angle of the first eccentric shaft, and a second phase angle sensor configured to output a second signal indicating a rotational angle of the second eccentric shaft. The controller is configured to control speed of at least one of the first and second motors responsive to a difference between the rotational angles indicated by the first and second signals.

BRIEF DESCRIPTION OF THE DRAWINGS

The accompanying drawings, which are included to provide a further understanding of the disclosure and are incorporated in and constitute a part of this application, illustrate certain non-limiting embodiments of inventive concepts. In the drawings.

DETAILED DESCRIPTION OF EMBODIMENTS

Figure 1:
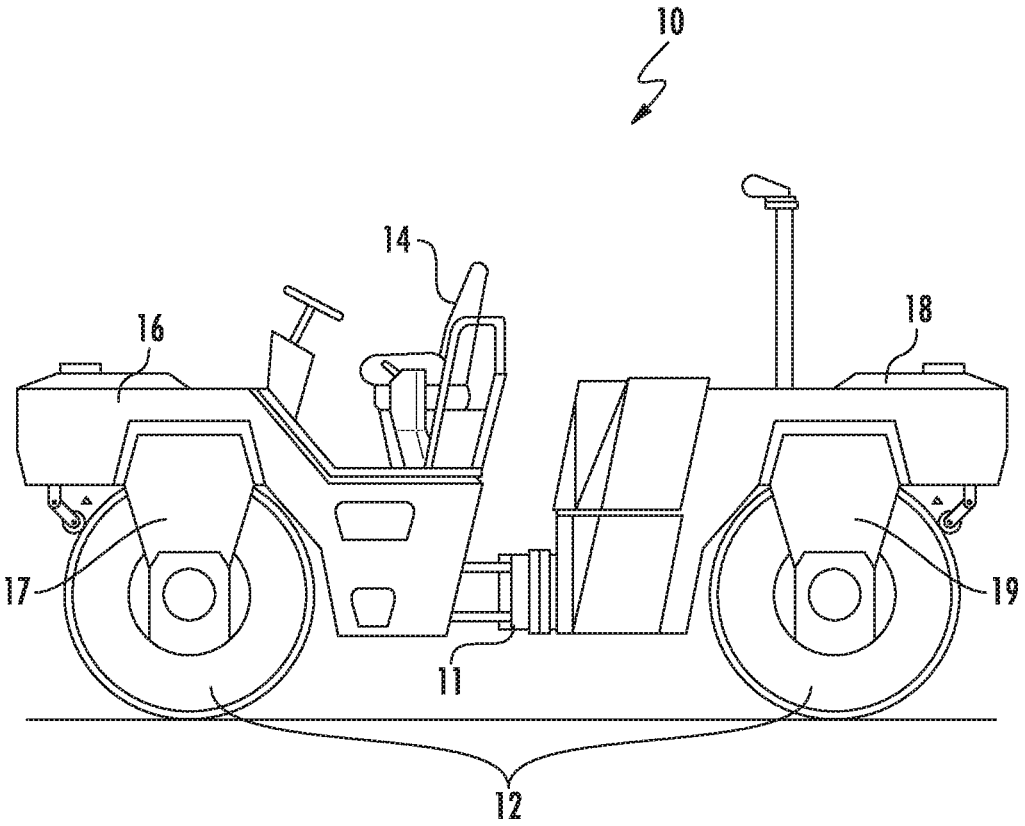
FIG. 1 is a side view of a surface compactor machine according to some embodiments of inventive concepts.

FIG. 1 illustrates a self-propelled roller-type surface compactor machine 10 according to some embodiments of inventive concepts. The surface compactor machine 10 can include a chassis 16, 18, rotatable drums 12 at the front and back at of the chassis, and a driver station including a seat 14 and a steering mechanism (e.g., a steering wheel) to provide driver control of the compaction machine. Moreover, each drum may be coupled to the chassis 16, 18 using a respective yoke 17, 19. One or both of the drums 12 may be driven by a drive motor in the chassis under control of the driver to propel the surface compactor machine 10. An articulable coupling 11 may be provided in the chassis to facilitate steering about a vertical axis. The drums 12 have a cylindrical outer surface that forms a compacting surface for compacting an underlying substrate, such as asphalt, gravel, soil, etc. One or both of the drums 12 each includes primary and second eccentric shafts that are rotated as discussed below to generate vibration forces that assist with compaction of the substrate.

Various embodiments are described herein by way of non-limiting examples in the context of the roller-type surface compactor machine 10. It is to be understood that the embodiments are not limited to the particular configurations disclosed herein and may furthermore be used with other types of surface compactor machines, including vibrating plate type surface compactor machines.

Figure 2:
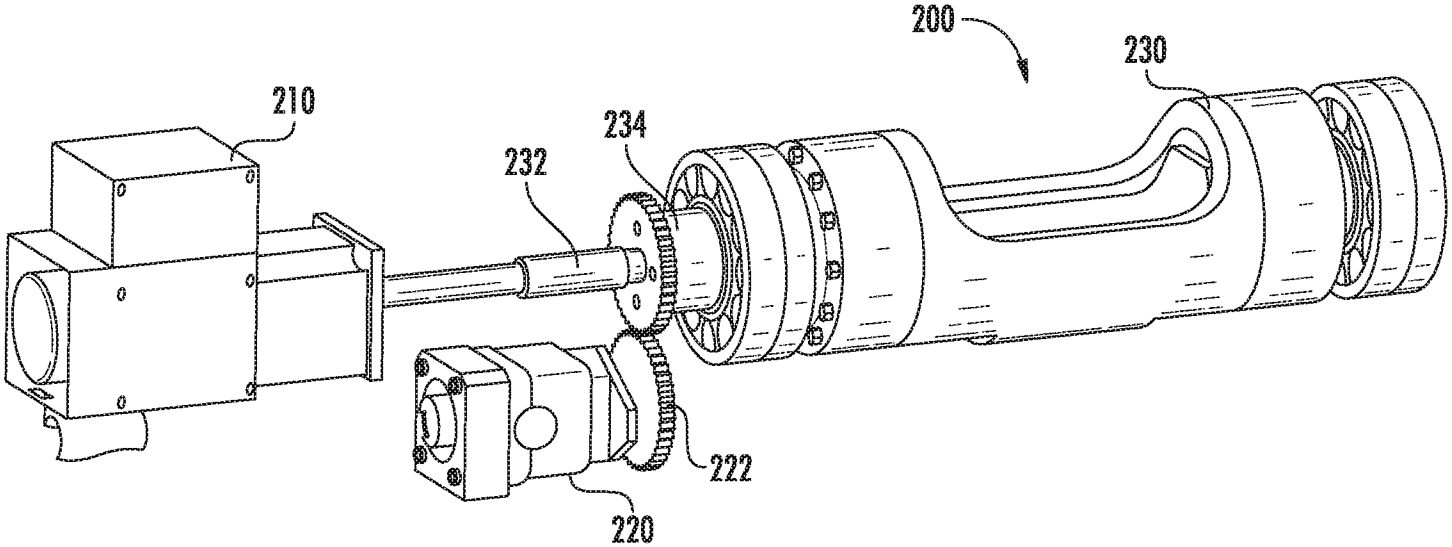
FIG. 2 is a perspective view of a vibration assembly having primary and secondary eccentric shafts that are rotated by a pair of motors and which may be used with the surface compactor machine of FIG. 1 according to some embodiments of inventive concepts.

FIG. 2 is a perspective view of a vibration assembly 200 having primary and secondary eccentric shafts 230 and 500 (FIG. 5) that are rotated by a pair of motors 220 and 210, and which may be used with the surface compactor machine of FIG. 1 according to some embodiments of inventive concepts. The secondary eccentric shaft 500 is at least partially enclosed in a hollow interior space of the primary eccentric shaft 230, according to some embodiments.

Figure 4:
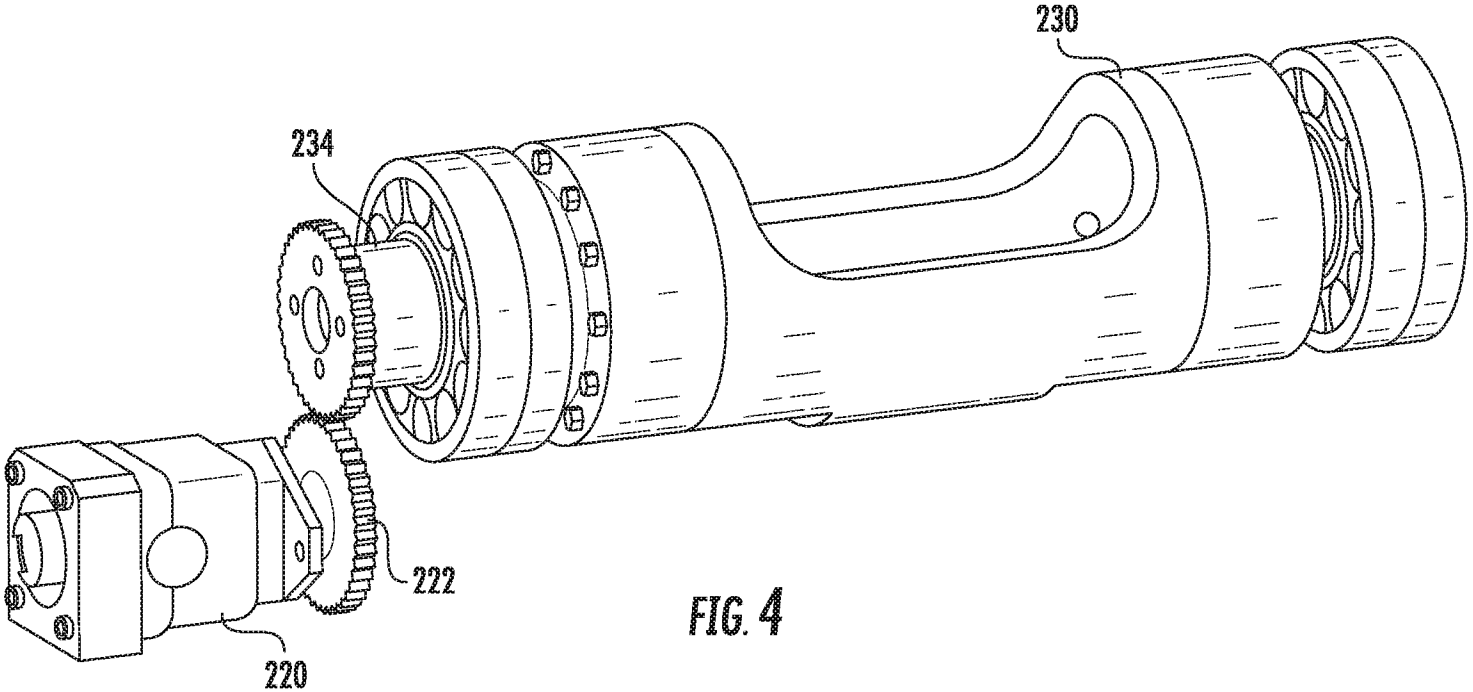
FIG. 4 is a perspective view of the primary eccentric shaft of FIG. 2 according to some embodiments of inventive concepts.
Figure 5:
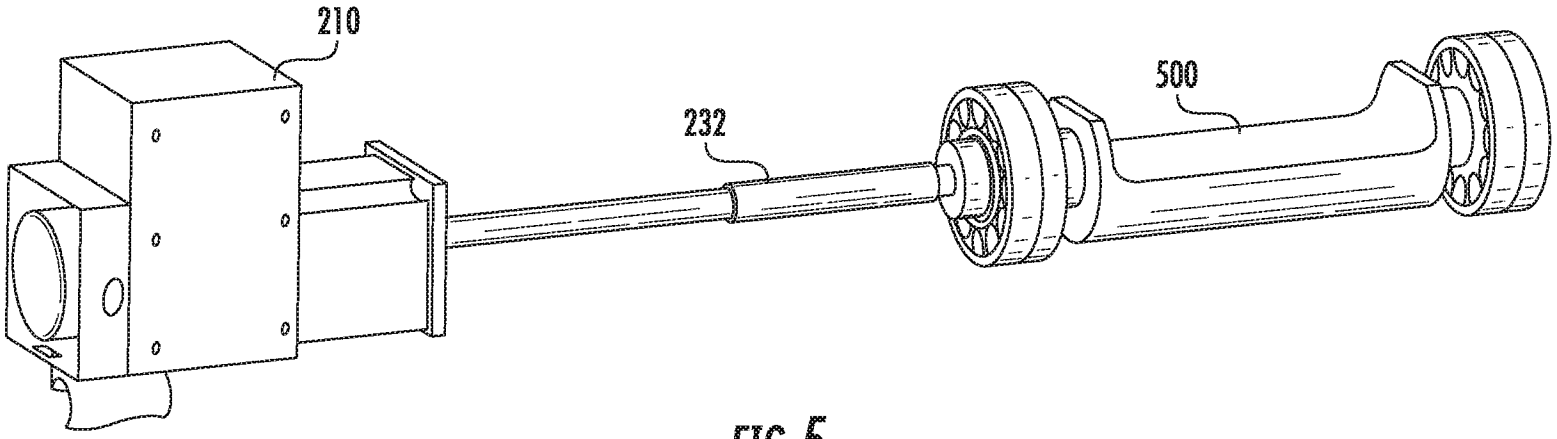
FIG. 5 is a perspective view of the secondary eccentric shaft of FIG. 2 according to some embodiments of inventive concepts.

FIG. 4 is a perspective view of the primary eccentric shaft 230 of FIG. 2 configured according to some embodiments of inventive concepts. FIG. 5 is a perspective view of the secondary eccentric shaft 500 of FIG. 2 configured according to some embodiments of inventive concepts. A first motor 220 is connected through a gear assembly 222 and a shaft 234 to rotate the primary eccentric shaft 230. A second motor 210 is connected through a shaft 232 to rotate the secondary eccentric shaft 500. In one embodiment, the first motor 220 is a hydraulic motor capable of rotating the primary eccentric shaft 230 and the second motor 210 is an electric motor capable of rotating the secondary eccentric shaft 500 at a higher rotational speed than the primary eccentric shaft 230.

The primary and secondary eccentric shafts 230 and 500 each have a center of mass that is located radially offset from their rotation axis. In the embodiment of FIGS. 2, 4, and 5, the primary and secondary eccentric shafts 230 and 500 are coaxially aligned along their rotational axes, and may also be coaxially aligned with or radially offset from the rotational axis of the drum 12 in which they reside. The motors 210 and 220 may be mounted to an interior space of the drum 12 or mounted outside the drum 12, such as mounted to the corresponding yoke 17,19. The primary eccentric shaft 230 has a greater mass and resulting eccentric moment about its rotational axis than the secondary eccentric shaft 500. Rotation of the primary and secondary eccentric shafts 230 and 500 generates vibration forces, which are transferred through a support assembly to the cylindrical roller surface of the drums 12 forming a compacting surface that compacts the substrate. The support structure includes sidewalls of the drums 12 and couplers to the motors 220 and 210 and/or the shafts 234 and 232.

Figure 6:
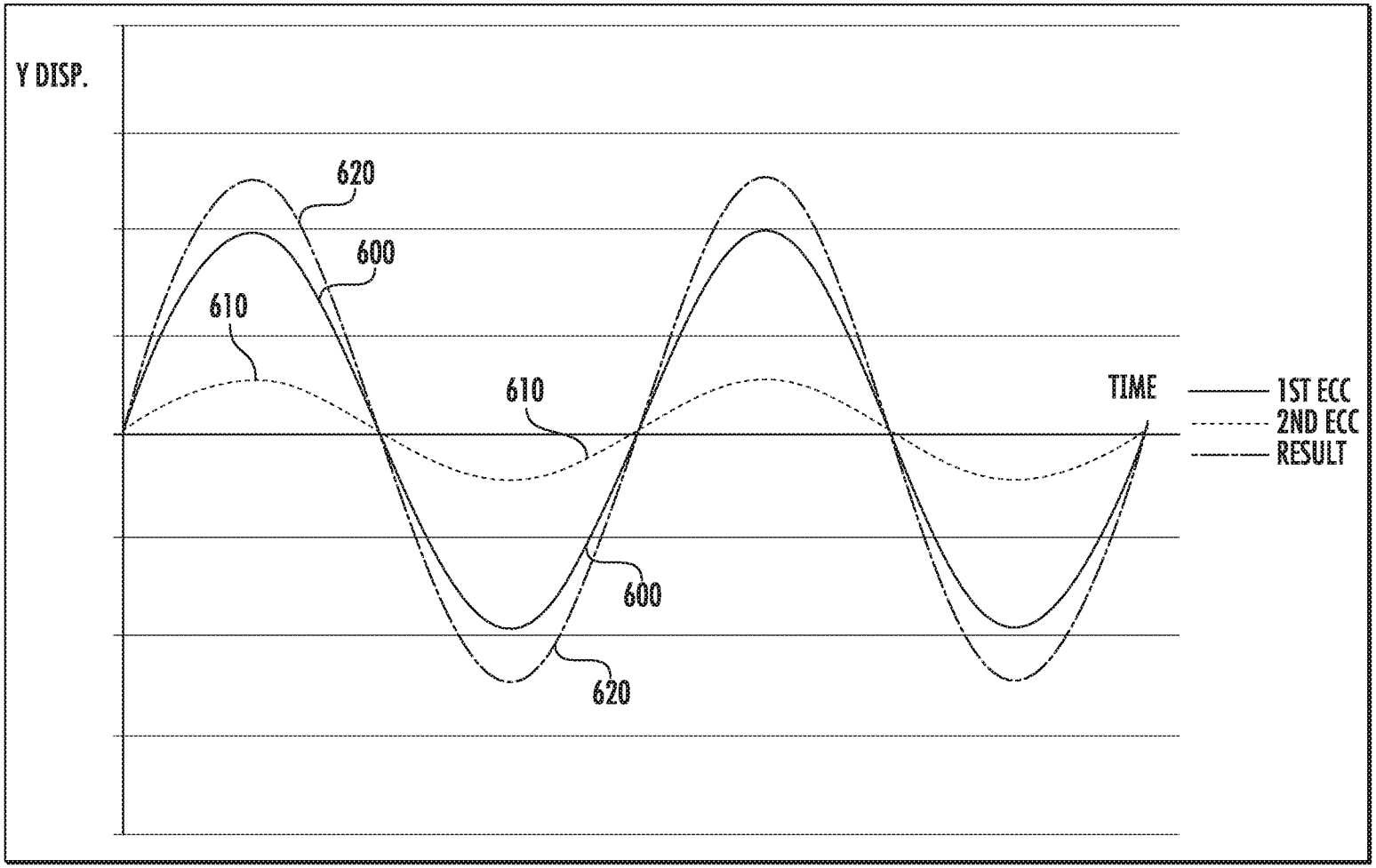
FIG. 6 illustrates graphs of the vertical displacement of the eccentric shafts over time, which may correspond to the vertical displacement of the drum, due to vibration forces generated by the primary and secondary eccentric shafts of FIG. 2.

FIG. 6 illustrates three graphs generated through simulation of the vertical displacement of the eccentric shafts over time, which may correspond to vertical displacement of the drum 12, due to vibration forces generated by the primary and secondary eccentric shafts 230 and 500 having certain mass and size configurations. Referring to FIG. 6, graph 600 illustrates the vertical displacement amplitude of the primary eccentric shaft 230 over time, and may correspond to the vertical displacement of the drum 12 due to vibration forces generated by rotation of the primary eccentric shaft 230 (i.e., without force contribution from the secondary eccentric shaft 500). Graph 610 illustrates the relatively smaller vertical displacement amplitude of the secondary eccentric shaft 500 over time, and which correspond to the vertical displacement of the drum 12 due to vibration forces generated by rotation of the secondary eccentric shaft 500 (i.e., without force contribution from the primary eccentric shaft 230). Graph 620 illustrates the combined vertical displacement of both the primary eccentric shaft 230 and the secondary eccentric shaft 500 over time, and which may correspond to the vertical displacement of the drum 12 due to the combined vibration forces generated by rotation of both the primary eccentric shaft 230 and the secondary eccentric shaft 500. It is observed that the primary and secondary eccentric shafts 230 and 500 are rotated with the same speed and aligned in rotational phase, which results in the additive effect of their vibration forces and increased resultant vertical displacement of the drum 12, as illustrated in graph 620. The rapid speed and high-amplitude of the sinusoidal shaped downward displacement of the drum 12 illustrated in FIG. 6 can result in formation of a bow wave of the substrate material forming in front of the drum 12, longitudinal displacement of the material from the substrate, fracturing of an aggregate of the substrate, and/or formation of marks on the substrate along edges of the cylindrical surface of the drum 12.

Some embodiments that are disclosed herein arise from the present realization that the relative rotational speed and phase between the rotating eccentric shafts of a surface compactor machine can be controlled to affect the speed at which the drum 12 is displaced downward and the shape of that displacement over time to avoid one or more of the problems that can arise when compressing a substrate. As will be explained below, a control system is provided that is configured to control the rotational speed and rotational angle relationships between the primary and secondary eccentric shafts 230 and 500 according to various defined relationships and ranges to shape how the drum 12 or other compacting surface moves downward over time to compact a substrate, and which may minimize or avoid formation of bow waves, longitudinal displacement of material from the substrate, fracture of substrate aggregate, and/or drum edge marks on the substrate.

Figure 3:
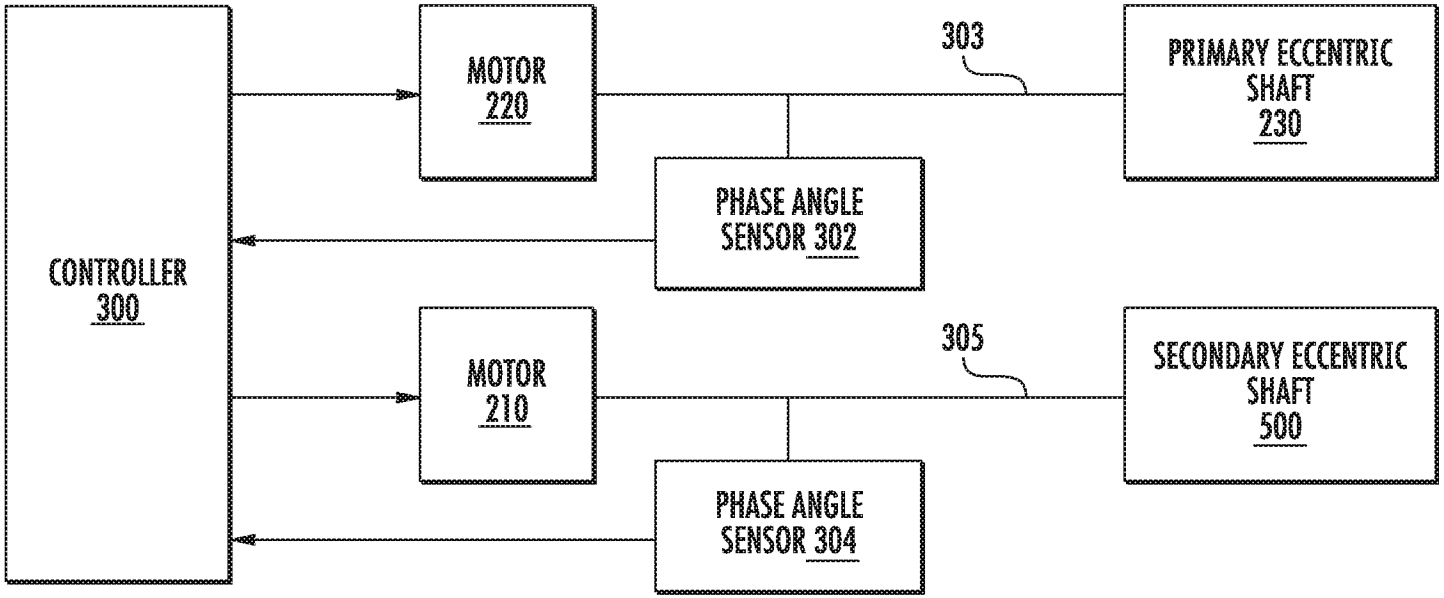
FIG. 3 is a block diagram of a control system that can be used to control rotation of the primary and secondary eccentric shafts of FIG. 2 according to some embodiments of inventive concepts.

FIG. 3 is a block diagram of a control system that can be used to control rotation of the primary and secondary eccentric shafts 230 and 500 of FIG. 2 according to some embodiments of inventive concepts. Referring to FIG. 3, the control system includes a controller 300 that controls speed of at least one of the first and second motors 220 and 210 so that a rotational speed of the secondary eccentric shaft 500 is an integer, greater than 1, times faster than a rotational speed of the primary eccentric shaft 230 to generate a composite displacement waveform that vibrates the compacting surface upwards and downwards, where the composite displacement waveform includes a zero amplitude coordinate, a wave section located above the zero amplitude coordinate, and a wave section located below the zero amplitude coordinate that is asymmetric relative to the wave section located above the zero amplitude coordinate.

As will be explained in further detail below, in some embodiments the controller 300 controls the speed so the wave section located below the zero amplitude coordinate includes a sequence of a first occurring downward peak, a second occurring upward peak, and a third occurring downward peak that has a larger downward amplitude than the first occurring downward peak. The speed may be controlled so that the maximum upward amplitude of the wave section located above the zero amplitude coordinate is greater than the maximum downward amplitude of the wave section located below the zero amplitude coordinate. The speed may be controlled so that a center of mass location of the secondary eccentric shaft 500 has a leading rotational angle offset ahead of a center of mass location of the primary eccentric shaft 230 when the center of mass location of the primary eccentric shaft 230 is at its maximum distance from the substrate to be compacted (e.g., the underlying asphalt, gravel, soil, etc.).

The control system can further include a first phase angle sensor 302 that is configured to output a first signal indicating a rotational angle of the primary eccentric shaft 230 (e.g., by monitoring shaft 303 in FIG. 3), and a second phase angle sensor 304 that is configured to output a second signal indicating a rotational phase angle of the secondary eccentric shaft 500 (e.g., by monitoring shaft 305 in FIG. 3). The controller 300 can be configured to control speed of at least one of the first and second motors 210 and 220 responsive to a difference between the rotational angles indicated by the first and second signals.

In some embodiments, the controller 300 controls speed of at least one of the first and second motors 220 and 210 so that the rotational speed of the secondary eccentric shaft 500 is two times faster than the rotational speed of the primary eccentric shaft 230 and so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate.

Figure 7:
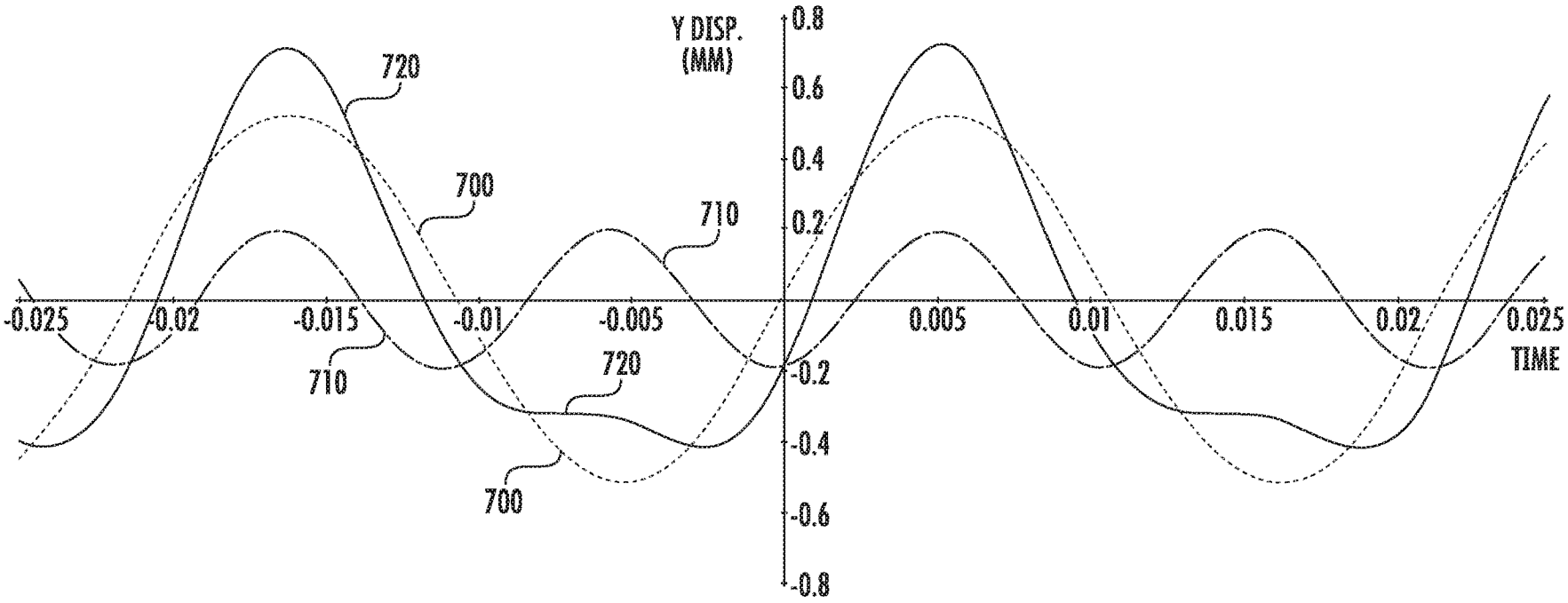
FIG. 7 illustrates graphs of the vertical displacement of the primary and secondary eccentric shafts over time, which may correspond to the vertical displacement of the drum due to vibration forces generated by the primary and secondary eccentric shafts of FIG. 2 while controlled by the controller of FIG. 3 according to some embodiments of inventive concepts.

FIG. 7 illustrates three graphs generated through simulation of the vertical displacement over time of the primary and secondary eccentric shafts 230 and 500 having the same mass and shape configurations used for the graphs illustrated in FIG. 6, and where the vertical displacement may correspond to that of the drum 12. In contrast to the displacement graphs of FIG. 6, to generate the displacement graphs of FIG. 7 the controller 300 controls the secondary eccentric shaft 500 to rotate two times faster than the primary eccentric shaft 230 and so that the center of mass location of the second eccentric shaft has a leading rotational angle offset of about 15 degrees ahead of the center of mass location of the first eccentric shaft in a direction of rotation of the primary and second eccentric shafts 230,500 when the center of mass location of the primary eccentric shaft 230 is at its maximum distance from the substrate.

Referring to FIG. 7, graph 700 illustrates the vertical displacement amplitude of the primary eccentric shaft 230 over time, which may correspond to the vertical displacement of the drum 12 due to vibration forces generated by rotation of the primary eccentric shaft 230 (i.e., without force contribution from the secondary eccentric shaft 500). Graph 710 illustrates the relatively smaller vertical displacement of the secondary eccentric shaft 500 over time, which may correspond to the vertical displacement of the drum 12 due to vibration forces generated by rotation of the secondary eccentric shaft 500 (i.e., without contribution from the primary eccentric shaft 230). Graph 720 illustrates a composite displacement waveform generated by the combined vibration forces generated by rotation of both the primary eccentric shaft 230 and the secondary eccentric shaft 500, which vibrates the compacting surface upwards and downwards. The composite displacement waveform of graph 720 includes a zero amplitude coordinate (i.e., 0 value along Y-axis), a wave section located above the zero amplitude coordinate (i.e., wave section above the X-axis), and a wave section located below the zero amplitude coordinate (i.e., wave section below the X-axis) that is asymmetric relative to the wave section located above the zero amplitude coordinate.

In the composite displacement waveform of graph 720 shown in FIG. 7, the wave section located below the zero amplitude coordinate includes a sequence of a first occurring downward peak, a second occurring upward peak, and a third occurring downward peak that has a larger downward amplitude than the first occurring downward peak. Moreover, in the illustrated embodiment, the maximum upward amplitude of the wave section located above the zero amplitude coordinate is greater than the maximum downward amplitude of the wave section located below the zero amplitude coordinate.

By the controller 300 rotating the secondary eccentric shaft 500 two times faster than the primary eccentric shaft 230 and with a leading rotational angle offset of about 15 degrees, the composite displacement waveform of graph 720 that is generated causes the drum 12 to move more slowly downward to compact the substrate over a greater time duration compared to how the drum 12 was moved when operating according to the vertical displacement graph 620 shown in FIG. 6. The more gradual rate of substrate compression provided by the composite displacement waveform of graph 720 may avoid formation of a bow wave of the substrate material in front of the drum 12, longitudinal displacement of the material from the substrate, fracturing of an aggregate of the substrate, and/or formation of marks on the substrate along edges of the cylindrical surface of the drum 12.

Figure 8A:
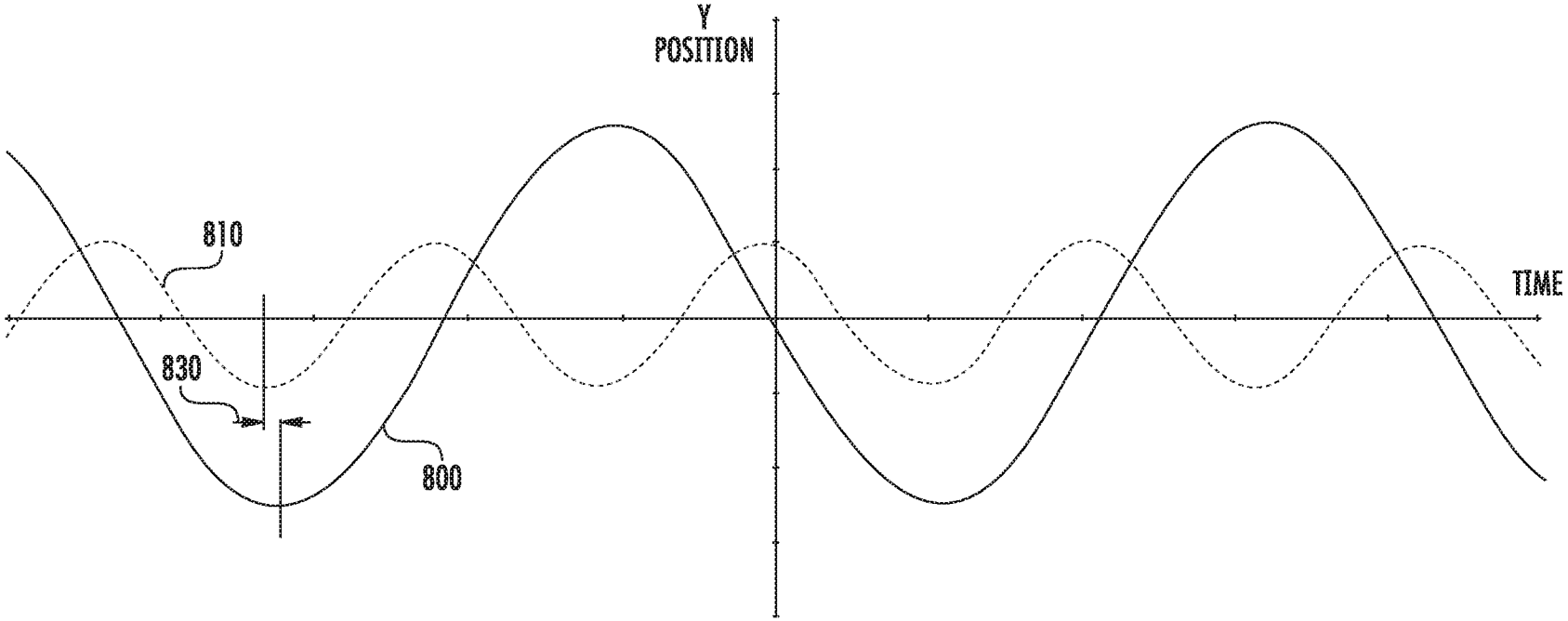
FIG. 8A illustrates graphs of the vertical location of the center of mass of the primary and secondary eccentric shafts of FIG. 2 while controlled by the controller of FIG. 3 to provide the displacement shown in FIG. 7 according to some embodiments of inventive concepts.

FIG. 8A illustrates a graph 800 showing the cyclical vertical location of the center of mass of the primary eccentric shaft 230 during rotation, and illustrates another graph 810 showing the cyclical vertical location of the center of mass of the secondary eccentric shaft 500 during rotation. The graphed rotations of the primary and secondary eccentric shafts 230 and 500 resulted in the corresponding vertical displacement graphs 700-720 shown in FIG. 7. Referring to FIG. 8A, the controller 300 operates to control the speed of at least one of the first and second motors 220 and 210 to cause the center of mass location of the secondary eccentric shaft 500 to have a leading rotational angle offset of about 15 degrees ahead of the center of mass location of the primary eccentric shaft 230 in a direction of rotation of the primary and secondary eccentric shafts 230,500 when the center of mass location of the primary eccentric shaft 230 is at its maximum distance from the substrate (i.e., illustrated at the lowest Y location in graph 810). The leading rotational phase angle of about 15 degrees is illustrated as the gap 830 between the marked minimum Y locations of the center of mass location of the primary and secondary eccentric shafts 230 and 500.

Figure 8B:
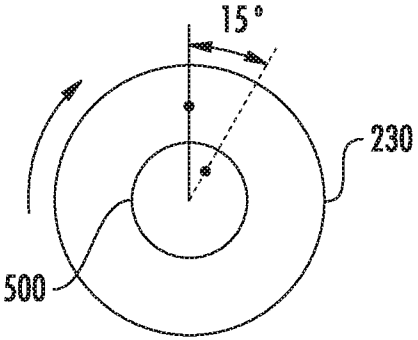
FIG. 8B illustrates a side cross-sectional view of the primary and secondary eccentric shafts of FIG. 2 showing the leading rotational angle offset of the center of mass location of the secondary eccentric shaft relative to the primary eccentric shaft according to some embodiments of inventive concepts.

FIG. 8B illustrates a simplified side cross-sectional view of the primary and secondary eccentric shafts of FIG. 2 showing the leading rotational angle offset of the center of mass location of the secondary eccentric shaft 500 relative to the primary eccentric shaft 230 in a direction of rotation of the primary and secondary eccentric shafts 230,500 according to some embodiments of inventive concepts. Referring to FIG. 8B, the center of mass location (indicated by the dot along the dashed radial line) of the secondary eccentric shaft 500 has a leading rotational angle offset of about 15 degrees ahead of the center of mass location (indicated by the dot along the solid vertical radial line) of the primary eccentric shaft 230 when the center of mass location of the primary eccentric shaft 230 is at its maximum distance from the substrate (i.e., at its lowest vertical location).

When the compactor machine 10 reverses direction, the primary and secondary eccentric shafts 230,500 can be controlled to operate in an opposite direction of rotation to that shown in FIG. 8B. The controller 300 then responsively controls the relative speed of the first and second motors 220,210 to provide a flipped image along the Y-axis of FIG. 8 with respect to the leading rotational angle offset from the secondary eccentric shaft 500 to the primary eccentric shaft 230 in the direction of rotation of the primary and secondary eccentric shafts 230,500. In other words, the controller 300 can respond to a reversal in the direction of rotation of the drum 12 by reversing a direction of rotation of the primary and secondary eccentric shafts 230,500. The controller can then control the relative speed of the primary and secondary eccentric shafts 230,500 so that the rotational speed of the second eccentric shaft 500 is 2 times faster than the rotational speed of the first eccentric shaft 230 and so that the center of mass location of the second eccentric shaft 500 has a leading rotational angle offset (in the direction of rotation of the drum 12) of about 15 degrees ahead of the center of mass location of the first eccentric shaft 230 when the center of mass location of the first eccentric shaft is at its maximum distance from the substrate.

Although controlling the relative speed of one or both of the motors 210 and 220 to provide a leading rotational angle offset of about 15 degrees in the direction of rotation of the primary and secondary eccentric shafts 230,500 advantageously can provide the composite displacement waveform discussed above with regard to the embodiment of graph 720, it has been determined that controlling the relative speed to provide a leading rotational angle offset, from the center of mass location of the secondary eccentric shaft 500 to the center of mass location of the primary eccentric shaft 230, that is within a range of about 5 degrees to about 45 degrees also provides a ramped-shaped composite displacement waveform over time that may operate to avoid formation of a bow wave of the substrate material in front of the drum 12, longitudinal displacement of the material from the substrate, fracturing of an aggregate of the substrate, and/or formation of marks on the substrate along edges of the cylindrical surface of the drum 12.

Figure 9:
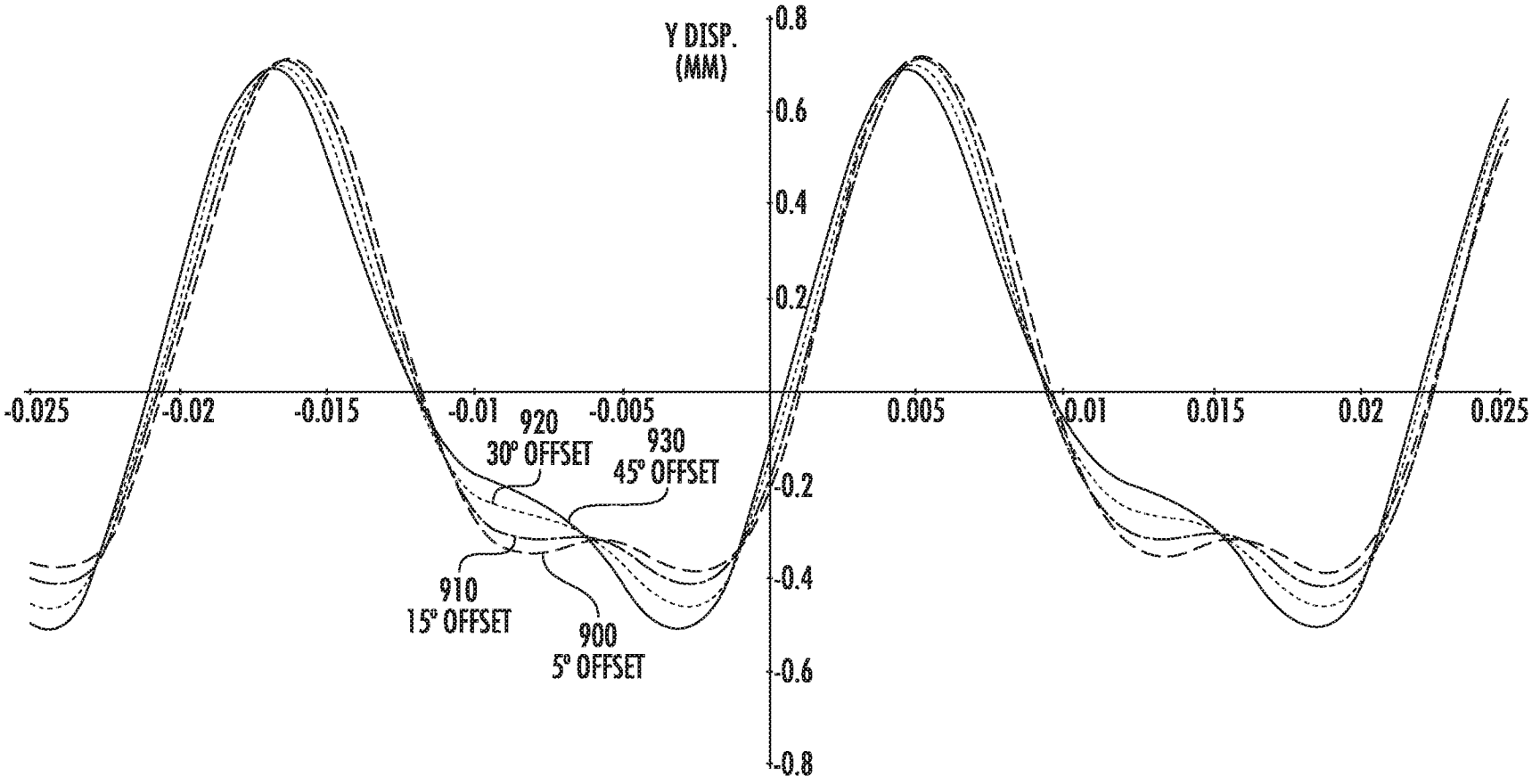
FIG. 9 illustrates graphs of composite displacement waveforms, which may correspond to the vertical displacement of the drum, due to vibration forces generated by the primary and secondary eccentric shafts of FIG. 2 while controlled by the controller of FIG. 3 to provide the illustrated range of leading rotational angle offsets according to some embodiments of inventive concepts.

FIG. 9 illustrates four graphs generated through simulation of composite displacement waveforms, which may correspond to the vertical displacement of the drum 12 due to vibration forces generated by the primary and secondary eccentric shafts 230,500 having the same speed, mass, and shape configurations as used for the graphs illustrated in FIGS. 7 and 8, but with the leading rotational angle offset regulated by the controller 300 to be 5 degrees for graph 900, 15 degrees for graph 910, 30 degrees for graph 920, and 45 degrees for graph 930. Referring to these graphs, it is observed that a leading rotational angle offset of 45 degrees provides a highly sloped composite displacement waveform, which may correspond to the rapid downward displacement of the drum 12 over time toward reaching the extent of its maximum downward vertical displacement. In contrast, a leading rotational angle offset of 30 degrees provides a less sloped composite displacement waveform, which may correspond to slower downward displacement of the drum 12 over time toward reaching the extent of its maximum downward vertical displacement. Similarly, a leading rotational angle offset of 15 degrees provides a still less sloped composite displacement waveform, which may correspond to a further slowdown in the downward displacement of the drum 12 over time toward reaching the extent of its maximum downward vertical displacement, and a leading rotational angle offset of 5 degrees further reduces the slope of the composite displacement waveform and slows the downward displacement of the drum 12 over time.

The leading rotational angle offset may be determined by the controller 300 based on a speed of the surface compactor machine 10 along a surface of the substrate. Controlling the slope of the composite displacement waveform, which may correspond to the downward compressive movement of the drum 12 over time, based on the speed of the surface compactor machine 10 may beneficially avoid one or more of the problems described herein associated with compacting a substrate. For example, the leading rotational angle offset between the primary and secondary eccentric shafts 230 and 500 may be controlled by the controller 300 to move toward one end of a defined range of the leading rotational angle offset (e.g., 5 degrees to about 45 degrees) based on the speed of the surface compactor machine 10 being below one or more defined threshold values. In contrast, the leading rotational angle offset between the primary and secondary eccentric shafts 230 and 500 may be controlled by the controller 300 to move toward the opposite end of the defined range of the leading rotational angle offset (e.g., 5 degrees to about 45 degrees) based on the speed of the surface compactor machine 10 being above one or more defined threshold values. The leading rotational angle offset may be varied by the controller 300 more continuously based on a presently determined speed of the surface compactor machine 10.

The controller 300 can be configured to control speed of at least one of the first and second motors 220 and 210 to regulate the leading rotational angle offset to be a value that is determined based on which operational mode among a plurality of operational modes has been electrically signaled to the controller 300 as a selection by an operator of the surface compactor machine 10. Alternatively or additionally, the controller 300 can be configured to control how many times faster the rotational speed of the secondary eccentric shaft 500 is provided compared to the rotational speed of the primary eccentric shaft 230, based on which operational mode among a plurality of operational modes has been electrically signaled to the controller 300 as a selection by an operator of the surface compactor machine 10.

In the above-description of various embodiments of the present disclosure, it is to be understood that the terminology used herein is for the purpose of describing particular embodiments only and is not intended to be limiting of the invention. Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 10:
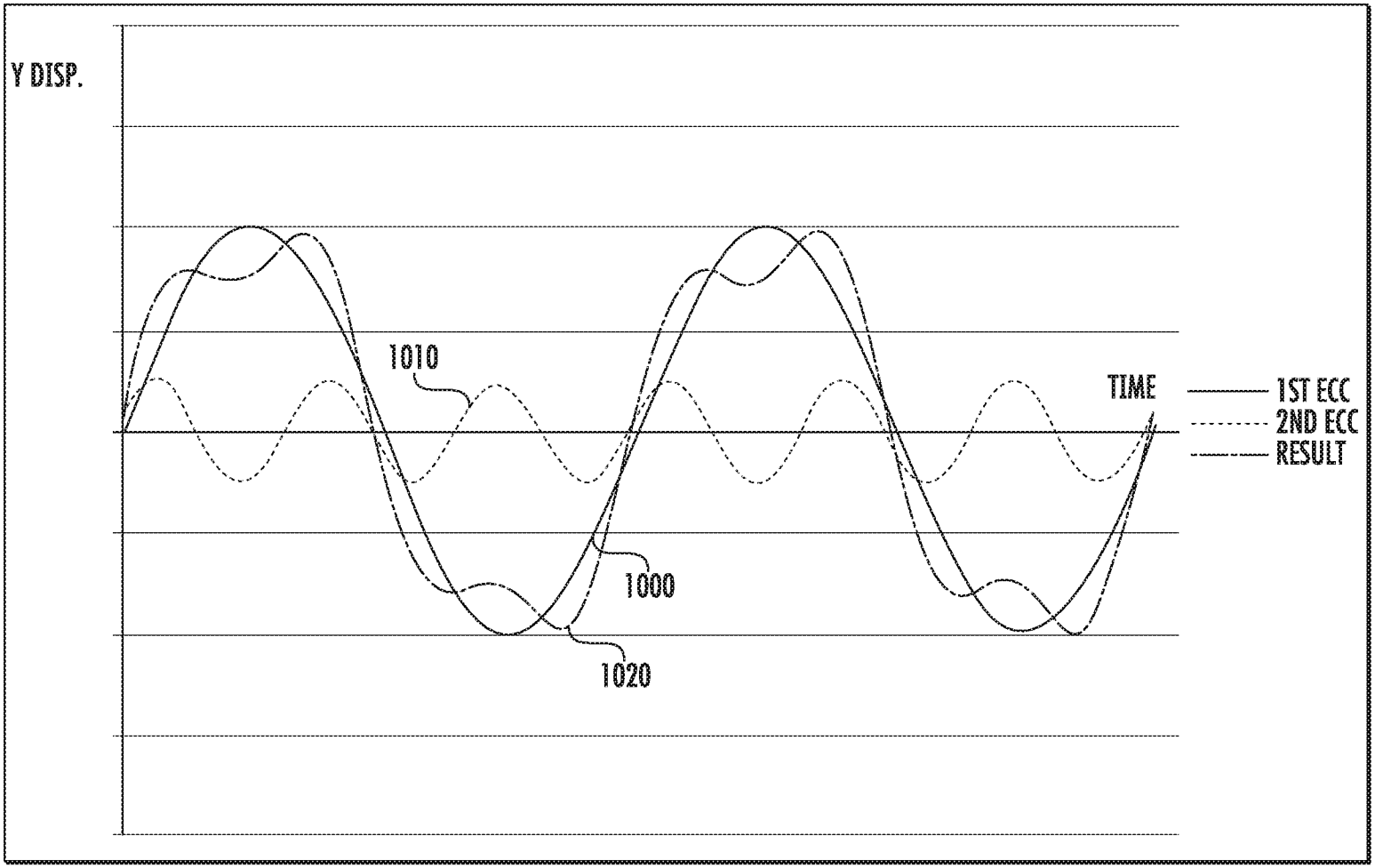
FIG. 10 illustrates graphs of the vertical displacement of the primary and secondary eccentric shafts over time, which may correspond to the vertical displacement of the drum due to vibration forces generated by the primary and secondary eccentric shafts of FIG. 2 while controlled by the controller of FIG. 3 according to some embodiments of inventive concepts.

Although the graphs of FIGS. 6-9 were developed through simulations where the rotational speed of the secondary eccentric shaft 500 is two times faster than the rotational speed of the primary eccentric shaft 230, as explained above, the rotational speed of the secondary eccentric shaft 500 can be controlled to be any integer, greater than 1 (e.g., 2, 3, 4, etc.), times faster than the rotational speed of the primary eccentric shaft 230. FIG. 10 illustrates graphs of the vertical displacement of the primary and secondary eccentric shafts 230 and 500 over time, which may correspond to the vertical displacement of the drum 12 due to vibration forces generated by the primary and secondary eccentric shafts 230 and 500 of FIG. 2 while controlled by the controller 300 of FIG. 3 to have a higher rotational speed difference. For the graphs of FIG. 10, the controller 300 controls the secondary eccentric shaft 500 to rotate three times faster than the primary eccentric shaft 230 and so that the center of mass location of the secondary eccentric shaft 500 has a leading rotational angle offset ahead of the center of mass location of the primary eccentric shaft 230 in the direction of rotation of the primary and secondary eccentric shafts 230 and 500, when the center of mass location of the primary eccentric shaft 230 is at its maximum distance from the substrate.

Graph 1000 illustrates the vertical displacement amplitude of the primary eccentric shaft 230 over time, which may correspond to the vertical displacement of the drum 12 due to vibration forces generated by rotation of the primary eccentric shaft 230 (i.e., without force contribution from the secondary eccentric shaft 500). Graph 1010 illustrates the relatively smaller vertical displacement amplitude of the secondary eccentric shaft 500 over time, which may correspond to the vertical displacement of the drum 12 due to vibration forces generated by rotation of the secondary eccentric shaft 500 (i.e., without contribution from the primary eccentric shaft 230). Graph 1020 illustrates a composite displacement waveform generated by the combined vibration forces generated by rotation of both the primary eccentric shaft 230 and the secondary eccentric shaft 500, which vibrates the compacting surface upwards and downwards.

It is observed in FIG. 10 that by rotating the secondary eccentric shaft 500 three times faster than the primary eccentric shaft 230 and with the leading rotational angle offset, the composite displacement waveform of graph 1020 includes a zero amplitude coordinate (i.e., 0 value along Y-axis), a wave section located above the zero amplitude coordinate (i.e., wave section above the X-axis), and a wave section located below the zero amplitude coordinate (i.e., wave section below the X-axis). Referring to the composite displacement waveform of graph 1020, the wave section located below the zero amplitude coordinate includes a sequence of a first occurring downward peak, a second occurring upward peak, and a third occurring downward peak that has a larger downward amplitude than the first occurring downward peak.

The shape of the composite displacement waveform of graph 1020 causes the drum 12 to move more slowly downward to compact the substrate over a greater time duration compared to how the drum 12 was moved when operating according to the vertical displacement graph 620 shown in FIG. 6. The more gradual rate of substrate compression provided by the composite displacement waveform of graph 1020 may avoid formation of a bow wave of the substrate material in front of the drum 12, longitudinal displacement of the material from the substrate, fracturing of an aggregate of the substrate, and/or formation of marks on the substrate along edges of the cylindrical surface of the drum 12.

When an element is referred to as being "connected", "coupled", "responsive", "mounted", or variants thereof to another element, it can be directly connected, coupled, responsive, or mounted to the other element or intervening elements may be present. In contrast, when an element is referred to as being "directly connected", "directly coupled", "directly responsive", "directly mounted" or variants thereof to another element, there are no intervening elements present. Like numbers refer to like elements throughout. As used herein, the singular forms "a", "an" and "the" are intended to include the plural forms as well, unless the context clearly indicates otherwise. Well-known functions or constructions may not be described in detail for brevity and/or clarity. The term "and/or" and its abbreviation "/" include any and all combinations of one or more of the associated listed items.

It will be understood that although the terms first, second, third, etc. may be used herein to describe various elements/operations, these elements/operations should not be limited by these terms. These terms are only used to distinguish one element/operation from another element/operation. Thus, a first element/operation in some embodiments could be termed a second element/operation in other embodiments without departing from the teachings of present inventive concepts. The same reference numerals or the same reference designators denote the same or similar elements throughout the specification.

As used herein, the terms "comprise", "comprising", "comprises", "include", "including", "includes", "have", "has", "having", or variants thereof are open-ended, and include one or more stated features, integers, elements, steps, components or functions but do not preclude the presence or addition of one or more other features, integers, elements, steps, components, functions or groups thereof.

Furthermore, as used herein, the common abbreviation "e.g.", which derives from the Latin phrase "exempli gratia," may be used to introduce or specify a general example or examples of a previously mentioned item, and is not intended to be limiting of such item. The common abbreviation "i.e.", which derives from the Latin phrase "id est," may be used to specify a particular item from a more general recitation.

Persons skilled in the art will recognize that certain elements of the above-described embodiments may variously be combined or eliminated to create further embodiments, and such further embodiments fall within the scope and teachings of inventive concepts. It will also be apparent to those of ordinary skill in the art that the above-described embodiments may be combined in whole or in part to create additional embodiments within the scope and teachings of inventive concepts. Thus, although specific embodiments of, and examples for, inventive concepts are described herein for illustrative purposes, various equivalent modifications are possible within the scope of inventive concepts, as those skilled in the relevant art will recognize. Accordingly, the scope of inventive concepts is determined from the appended claims and equivalents thereof.

The invention claimed is:

1. A surface compactor machine, comprising:

a compacting surface for compacting a substrate;

a first motor that rotates a first eccentric shaft;

a second motor that rotates a second eccentric shaft;

a support assembly connected to the first and second eccentric shafts to transfer vibration forces to the compacting surface; and a controller that controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

2. The surface compactor machine of claim 1, wherein:

the wave section located below the zero amplitude coordinate includes a sequence of a first occurring downward peak, a second occurring upward peak, and a third occurring downward peak that has a larger downward amplitude than the first occurring downward peak.

3. The surface compactor machine of claim 1, wherein:

the maximum upward amplitude of the wave section located above the zero amplitude coordinate is greater than the maximum downward amplitude of the wave section located below the zero amplitude coordinate.

4. The surface compactor machine of claim 1, wherein:

the surface compactor machine comprises a roller compactor;

the compacting surface comprises a cylindrical drum that is connected to the support assembly and encloses the first and second eccentric shafts.

5. The surface compactor machine of claim 1, further comprising:

a first phase angle sensor configured to output a first signal indicating a rotational angle of the first eccentric shaft; and a second phase angle sensor configured to output a second signal indicating a rotational angle of the second eccentric shaft, wherein the controller controls speed of at least one of the first and second motors responsive to a difference between the rotational angles indicated by the first and second signals.

6. The surface compactor machine of claim 1, wherein:

the first eccentric shaft has a greater mass than the second eccentric shaft.

7. The surface compactor machine of claim 6, wherein:

the first and second eccentric shafts are coaxially aligned along their rotational axes; and at least a portion of the second eccentric shaft is enclosed by the first eccentric shaft.

8. The surface compactor machine of claim 1, wherein:

the controller controls the speed of at least one of the first and second motors so that a center of mass location of the second eccentric shaft has a leading rotational angle offset ahead of a center of mass location of the first eccentric shaft in a direction of rotation of the first and second eccentric shafts when the center of mass location of the first eccentric shaft is at its maximum distance from the substrate.

9. The surface compactor machine of claim 8, wherein:

the first eccentric shaft has a greater mass than the second eccentric shaft; and the controller controls the speed of at least one of the first and second motors so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate.

10. The surface compactor machine of claim 9, wherein:

the controller controls the speed of at least one of the first and second motors so that the rotational speed of the second eccentric shaft is 2 times faster than the rotational speed of the first eccentric shaft and so that the center of mass location of the second eccentric shaft has a leading rotational angle offset of about 15 degrees ahead of the center of mass location of the first eccentric shaft when the center of mass location of the first eccentric shaft is at its maximum distance from the substrate.

11. The surface compactor machine of claim 8, wherein the controller controls the speed of at least one of the first and second motors to regulate the leading rotational angle offset, from the center of mass location of the second eccentric shaft to the center of mass location of the first eccentric shaft when the center of mass location of the first eccentric shaft is at its maximum distance from the substrate, to be a value determined based on which operational mode among a plurality of operational modes has been electrically signaled to the controller as a selection by an operator of the surface compactor machine.

12. A method of operating a surface compactor machine having a compacting surface for compacting a substrate, a first motor that that rotates a first eccentric shaft, a second motor that rotates a second eccentric shaft, and a support assembly connected to the first and second eccentric shafts to transfer vibration forces to the compacting surface, the method comprising:

operating a controller to control speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

13. The method of claim 12, wherein:

the wave section located below the zero amplitude coordinate includes a sequence of a first occurring downward peak, a second occurring upward peak, and a third occurring downward peak that has a larger downward amplitude than the first occurring downward peak.

14. The method of claim 12, wherein:

the maximum upward amplitude of the wave section located above the zero amplitude coordinate is greater than the maximum downward amplitude of the wave section located below the zero amplitude coordinate.

15. The method of claim 12, further comprising:

operating the controller to control the speed of at least one of the first and second motors so that a center of mass location of the second eccentric shaft has a leading rotational angle offset ahead of a center of mass location of the first eccentric shaft in a direction of rotation of the first and second eccentric shafts when the center of mass location of the first eccentric shaft is at its maximum distance from the substrate.

16. The method of claim 15, wherein the first eccentric shaft has a greater mass than the second eccentric shaft, and further comprising:

operating the controller to control the speed of at least one of the first and second motors so that the center of mass location of the second eccentric shaft has a leading rotational angle offset within a range of about 5 degrees to about 45 degrees ahead of the center of mass location of the first eccentric shaft when the center of mass location of the first eccentric shaft is at its maximum distance from the substrate.

17. The method of claim 16, further comprising;

operating the controller to control the speed of at least one of the first and second motors so that the rotational speed of the second eccentric shaft is 2 times faster than the rotational speed of the first eccentric shaft and so that the center of mass location of the second eccentric shaft has a leading rotational angle offset of about 15 degrees ahead of the center of mass location of the first eccentric shaft when the center of mass location of the first eccentric shaft is at its maximum distance from the substrate.

18. The method of claim 15, further comprising;

operating the controller to control speed of at least one of the first and second motors to regulate the leading rotational angle offset, from the center of mass location of the second eccentric shaft to the center of mass location of the first eccentric shaft when the center of mass location of the first eccentric shaft is at its maximum distance from the substrate, to be a value determined based on which operational mode among a plurality of operational modes has been electrically signaled to the controller as a selection by an operator of the surface compactor machine.

19. The method of claim 12, further comprising;

providing to the controller a first signal output by a first phase angle sensor indicating a rotational angle of the first eccentric shaft; and providing to the controller a second signal output by a second phase angle sensor indicating a rotational angle of the second eccentric shaft; and operating the controller to control the speed of at least one of the first and second motors responsive to a difference between the rotational angles indicated by the first and second signals.

20. A control system for a surface compactor machine having a compacting surface for compacting a substrate, a first motor that rotates a first eccentric shaft, a second motor that rotates a second eccentric shaft, and a support assembly connected to the first and second eccentric shafts to transfer vibration forces to the compacting surface, the control system comprising:

a controller that controls speed of at least one of the first and second motors so that a rotational speed of the second eccentric shaft is an integer, greater than 1, times faster than a rotational speed of the first eccentric shaft to generate a composite displacement waveform that vibrates the compacting surface upwards and downwards, wherein the composite displacement waveform includes a zero amplitude coordinate, a wave section located above the zero amplitude coordinate, and a wave section located below the zero amplitude coordinate that is asymmetric relative to the wave section located above the zero amplitude coordinate.

* * * * *